US008439234B2

(12) United States Patent
Chen

(10) Patent No.: US 8,439,234 B2
(45) Date of Patent: May 14, 2013

(54) NON-DRIPPING SUCK-BACK NOZZLE

(75) Inventor: Chiuhuo Chen, Shanghai (CN)

(73) Assignee: Shanghai SR Packaging Technology Co., Ltd, Shanghai (CN)

( * ) Notice: Subject to any disclaimer, the term of this patent is extended or adjusted under 35 U.S.C. 154(b) by 0 days.

(21) Appl. No.: 13/516,235

(22) PCT Filed: Aug. 27, 2010

(86) PCT No.: PCT/CN2010/076403

§ 371 (c)(1),
(2), (4) Date: Jun. 15, 2012

(87) PCT Pub. No.: WO2011/076020

PCT Pub. Date: Jun. 30, 2011

(65) Prior Publication Data

US 2012/0248156 A1 Oct. 4, 2012

(30) Foreign Application Priority Data

Dec. 21, 2009 (CN) ..... 2009 2 0213472 U

(51) Int. Cl.
*B65D 88/54* (2006.01)

(52) U.S. Cl.
USPC ..... 222/321.3; 222/571

(58) Field of Classification Search ..... 222/321.3, 222/321.1, 321.2, 321.7, 321.9, 571, 108–111
See application file for complete search history.

(56) References Cited

U.S. PATENT DOCUMENTS

| | | | | |
|---|---|---|---|---|
| 5,482,188 | A * | 1/1996 | Lina | 222/321.2 |
| 5,803,318 | A * | 9/1998 | Lina | 222/321.2 |
| 6,036,059 | A * | 3/2000 | VanBrocklin | 222/321.9 |
| 6,196,424 | B1 * | 3/2001 | Bougamont et al. | 222/321.9 |
| 6,332,561 | B1 * | 12/2001 | Garcia et al. | 222/321.3 |
| 7,108,160 | B2 * | 9/2006 | Moretti | 222/321.7 |
| 7,748,576 | B2 * | 7/2010 | Tseng | 222/321.2 |
| 8,016,164 | B2 * | 9/2011 | Pares et al. | 222/321.2 |

* cited by examiner

*Primary Examiner* — Lien Ngo

(57) ABSTRACT

A non-dripping suck-back nozzle has a shell comprising a press cover (1), a revolving cover (2) and a cylinder (7). A needle valve (6) comprises a round rod (61) and a convex ring (62). The upper part of the round rod (61) of the needle valve (6) passes through an inner round pole (51) of a piston (5) and extends into a hollow channel (41) of a connecting bar (4). The round rod (61) and the connecting bar (4) are locked by each other. A channel is formed between the round rod (61) and the connecting bar (4). A space is formed between the round rod (61) and the inner round pole (51) of the piston (5).

4 Claims, 6 Drawing Sheets

NON-DRIPPING SUCK-BACK NOZZLE

BACKGROUND OF THE INVENTION

1. Field of the Invention

The present invention relates to a nozzle and more particularly to a non-dripping suck-back nozzle.

2. Description of Related Art

A conventional nozzle comprises a press cover, a spring, a fixing sleeve, a piston, a tube, a needle, valve and a cylinder. The press cover has an output channel at one end thereof. The output channel passes through the spring, the fixing sleeve and the piston to connect to the tube. The fixing sleeve has a circular shoulder at a top end thereof. One end of the spring abuts against a top plate of the circular shoulder. Another end of the spring abuts against the press cover. The needle valve is tightly plugged into a bottom end of the tube. The output channel of the press cover, the piston, the tube and the needle valve are all inserted into the cylinder to connect a top end of the cylinder to a bottom plate of the circular shoulder. A straw is connected to a bottom end of the cylinder. Thereafter, the conventional nozzle is further set onto a dispenser with a volume of fluid via the fixing sleeve which is fixed onto an opening of the dispenser. In addition, the cylinder is initially full of the fluid.

Under this arrangement, when a user presses the press cover, a space of the cylinder is compressed by the needle valve so that the fluid is flowed upwardly by the said compression and flows into the output channel of the press cover. As a result, the fluid is dispensed out from the press cover of the dispenser via the output channel of the press cover.

However, the conventional nozzle has one disadvantage as following:

When the user releases the press cover, the fluid in the output channel near a top of the press cover would unexpectedly drop out from the press cover of the conventional nozzle. Therefore, it is very inconvenient for a user to use the conventional nozzle.

The present invention has arisen to mitigate and/or obviate the disadvantages of the conventional.

SUMMARY OF THE INVENTION

The main objective of the present invention is to provide an improved nozzle.

To achieve the objective, a non-dripping suck-back nozzle which is set onto a dispenser comprises a press cover having a horizontal channel defined therein, a revolving cover, the press cover being movable relative to the revolving cover, the revolving cover screwed onto the dispenser, a cylinder being set into a top opening of the dispenser, the cylinder having a top shoulder formed around one end thereof, a bottom of the top shoulder abutting against the top opening of the dispenser, an upper chamber and a lower chamber both defined in the cylinder, at least one exhaust hole opened on the upper chamber of the cylinder, a bead, a spring, a needle valve, a second piston and a connecting bar being set into the cylinder, the connecting bar axially connected to the press cover, the connecting bar having a hollow channel, the hollow channel communicating with the horizontal channel of the press cover, the second piston having an inner round pole, an outer part and a connecting ring, the inner round pole being hollow, the outer part enclosing the inner round pole, the connecting ring formed between the inner round pole and the outer part, the connecting ring corresponding to a middle of the outer part, the inner round pole, the outer part and a top of the connecting ring defining a connecting ring-shaped groove, the connecting bar having a lower periphery defined at a lower end thereof, if the lower periphery of the connecting bar is plugged into the connecting ring-shaped groove to abut against the connecting ring of the second piston, it is airtight between the second piston and the connecting bar, the connecting bar and the second piston both set in the upper chamber of the cylinder, the bead being set in the lower chamber of the cylinder, the needle valve having a round rod and a convex ring, the convex ring defined around the round rod, a top end of the round rod of the needle valve passing through the inner round pole of the second piston and the round rod inserted into the hollow channel of the connecting bar, the needle valve moved by the motion of the connecting bar which is axially moved by the press cover, a plurality of first sub channels defined between the connecting bar and the round rod so that a volume of fluid from the dispenser can flow into the horizontal channel of the press cover via the first sub channels, a plurality of second ribs which is extended upwardly from the convex ring being axially defined on the round rod, a plurality of second sub channels respectively defined by each two adjacent second ribs on the round rod and the inner round pole so that the fluid from the dispenser can flow into the first sub channel via the second sub channel, an annular groove defined on the convex ring, one end of the spring abutting against a bottom of the lower chamber, another end of the spring enclosing the round rod and abutting against the convex ring of the needle valve, if the needle valve is moved toward the second piston by an elasticity of the spring until the annular groove of the needle valve abuts against the inner round pole of the second piston, it is airtight between the second piston and the needle valve. Wherein, a plurality of first ribs is axially defined on a wall of the hollow channel; the first ribs tightly abut against the round rod of the needle valve; the first sub channels are defined between the connecting bar and the round rod so that the fluid from the dispenser can flow into the horizontal channel of the press cover via the first sub channels; a top end and a bottom end of the outer part are both oblique from the inner round pole; a first piston is set into the cylinder; the first piston is fixed between the revolving cover and the top shoulder of the cylinder; the top end of the outer part of the second piston abuts against a bottom end of the first piston for preventing the second piston over moving upwardly.

Under this arrangement, when the lower periphery of the connecting bar is plugged into the connecting ring-shaped groove to abut against the connecting ring of the second piston, the annular groove of the needle valve departs from the inner round pole of the second piston; when the annular groove of the needle valve abuts against the inner round pole of the second piston so that it is airtight between the second piston and the needle valve, the lower periphery of the connecting bar departs from the connecting ring of the second piston; in addition, because the lower periphery departs from the connecting ring, a space between the connecting bar and the needle valve is enlarged.

Further benefits and advantages of the present invention will become apparent after a careful reading of the detailed description with appropriate reference to the accompanying drawings.

DETAILED DESCRIPTION OF THE INVENTION

Figure 1:
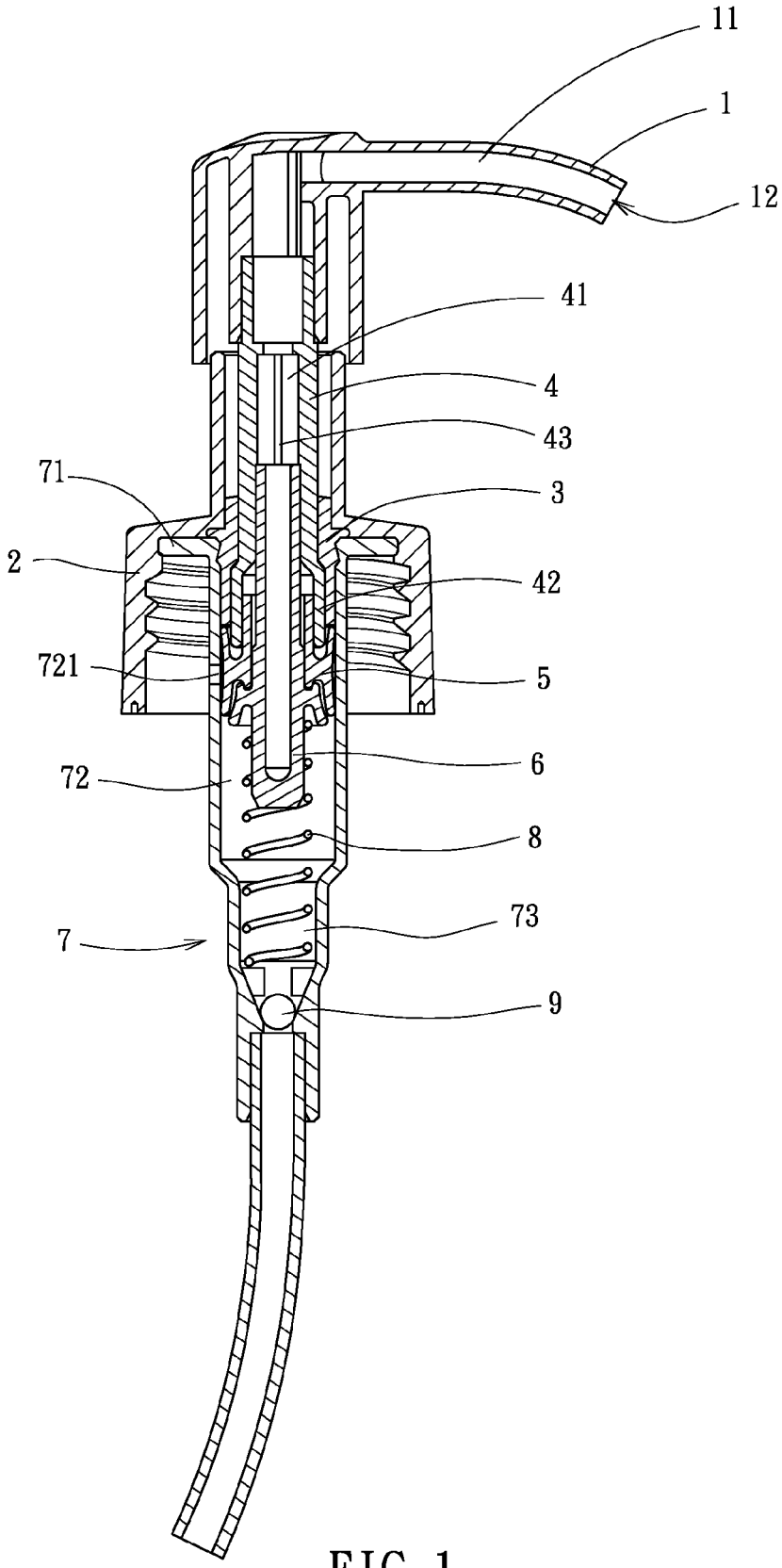
FIG. 1 is a cross-sectional view of a non-dripping suck-back nozzle of the present invention.
Figure 2:
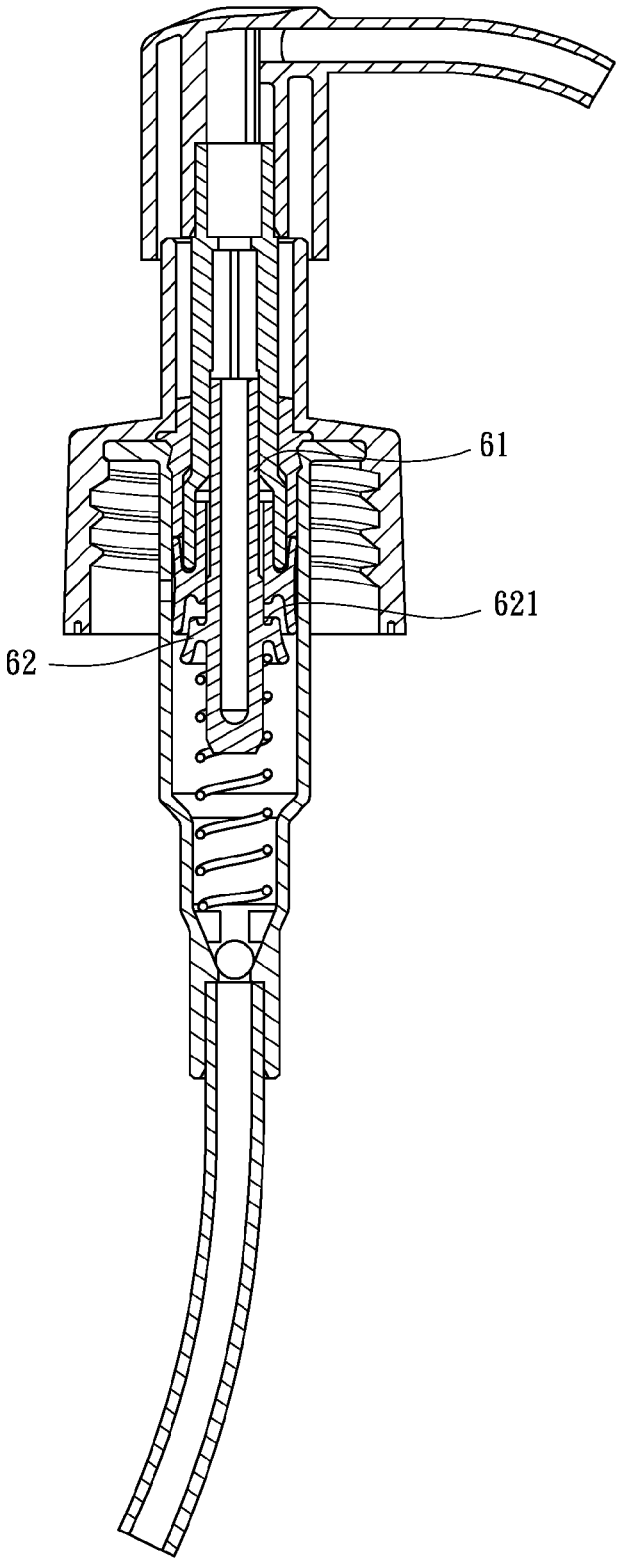
FIG. 2 is a cross-sectional view for showing an annular groove which departs from an inner round pole when a user presses a press cover.

Referring to the drawings to FIGS. 5-12, a non-dripping suck-back nozzle in accordance with the present invention comprises a press cover 1, a revolving cover 2 and a cylinder 7.

The press cover 1 is movable relative to the revolving cover 2. A horizontal channel 11 is defined in the press cover 1. One end of the horizontal channel 11 is defined as an outlet 12.

The revolving cover 2 is screwed onto a dispenser (not shown).

The cylinder 7 is set into a top opening of the dispenser (not shown). The cylinder 7 has a top shoulder 71 formed around one end thereof. A bottom of the top shoulder 71 abuts against the top opening of the dispenser. An upper chamber 72 and a lower chamber 73 are both defined in the cylinder 7. At least one exhaust hole 721 is opened on the upper chamber 72 of the cylinder 7.

A bead 9, a spring 8, a needle valve 6, a second piston 5, a connecting bar 4 and a first piston 3 are set into the cylinder 7 (as shown in FIGS. 1-4).

The first piston 3 is fixed between the revolving cover 2 and the top shoulder 71 of the cylinder 7. The connecting bar 4 and the second piston 5 are both set in the upper chamber 72 of the cylinder 7. The bead 9 is set in the lower chamber 73 of the cylinder 7. The connecting bar 4 is axially connected to the press cover 1. The connecting bar 4 has a hollow channel 41. The hollow channel 41 communicates with the horizontal channel 11 of the press cover 1. The second piston 5 is axially movable in the upper chamber 72 of the cylinder 7. The second piston 5 has an inner round pole 51, an outer part 52 and a connecting ring 53. The inner round pole 51 is hollow. The outer part 52 encloses the inner round pole 51. The connecting ring 53 is formed between the inner round pole 51 and the outer part 52. The connecting ring 53 is corresponding to a middle of the outer part 52. The inner round pole 51, the outer part 52 and a top of the connecting ring 53 define a connecting ring-shaped groove 54. A top end of the outer part 52 abuts against a bottom end of the first piston 3 for limiting the second piston 5 to over move upwardly. The top end and a bottom end of the outer part 52 are both oblique from the inner round pole 51. The connecting bar 4 has a lower periphery 42 defined at a lower end thereof. If the lower periphery 42 of the connecting bar 4 is plugged into the connecting ring-shaped groove 54 to abut against the connecting ring 53 of the second piston 5, it is airtight between the second piston 5 and the connecting bar 4.

The needle valve 6 has a round rod 61 and a convex ring 62. The convex ring 62 is defined around the round rod 61. A top end of the round rod 61 of the needle valve 6 passes through the inner round pole 51 of the second piston 5 and the round rod 61 is inserted into the hollow channel 41 of the connecting bar 4. A plurality of first ribs 43 is axially defined on a wall of the hollow channel 41. The first ribs 43 tightly abut against the round rod 61 of the needle valve 6 so that the needle valve 6 is moved by the motion of the connecting bar 4 which is axially moved by the press cover 1. A plurality of first sub channels is defined by each two adjacent first ribs 43 on the hollow channel 41 and the round rod 61 (as shown in FIGS. 1-4) so that a volume of fluid from the dispenser can flow into the horizontal channel 11 of the press cover 1 via the first sub channels. A plurality of second ribs 63 extended upwardly from the convex ring 62 is axially defined on the round rod 61.

A plurality of second sub channels is respectively defined by each two adjacent second fibs 63 on the round rod 61 and the inner round pole 51 (as shown in FIGS. 1-4) so that the fluid from the dispenser can flow into the first sub channel via the second sub channel.

An annular groove 621 is defined on the convex ring 62. The annular groove 621 of the needle valve 6 is corresponding to the inner round pole 51 of the second piston 5. One end of the spring 8 abuts against a bottom of the lower chamber 73. Another end of the spring 8 encloses the round rod 61 and abuts against the convex ring 62 of the needle valve 6. If the needle valve 6 is moved toward the second piston 5 by an elasticity of the spring 8 until the annular groove 621 of the needle valve 6 abuts against the inner round pole 51 of the second piston 5, it is airtight between the second piston 5 and the needle valve 6. The cylinder 7 is initially full of the fluid (how to make the fluid flow into the cylinder 7 is well known in the related art, so that it would not be further described in the present invention).

Figure 3:
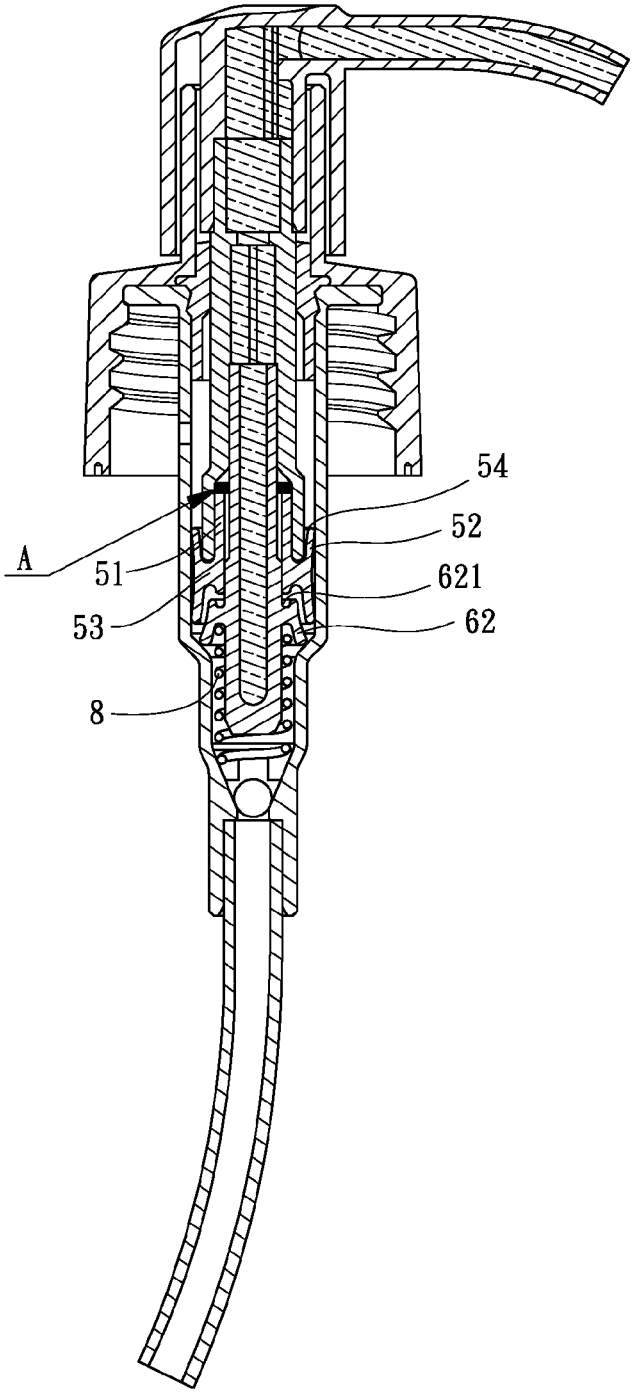
FIG. 3 is a cross-sectional view for showing that a space of an upper chamber is compressed by a round rod when the user presses the press cover.

Under this arrangement, referring to FIG. 3, when a user presses the press cover 1, the needle valve 6 is downward moved by the motion of the connecting bar 4 which is downward moved by the press cover 1; then, the lower periphery 42 of the connecting bar 4 is plugged into the connecting ring-shaped groove 54 to abut against the connecting ring 53 of the second piston 5; simultaneously, the annular groove 621 of the needle valve 6 departs from the inner round pole 51 of the second piston 5 so that it is not airtight between the second piston 5 and the needle valve 6; thereafter, a space of the upper chamber 72 is compressed by the round rod 61 (as shown in FIG. 3) so that the fluid is flowed upwardly by the said compression and flows into the second sub channel, the first sub channel and the horizontal channel 11; finally, the fluid is dispensed out from the dispenser via the outlet 12. In addition, when the second piston 5 is moved away from the exhaust hole 721, the outside air can flow into the upper chamber 72 to adjust the air pressure in the upper chamber 72.

Figure 4:
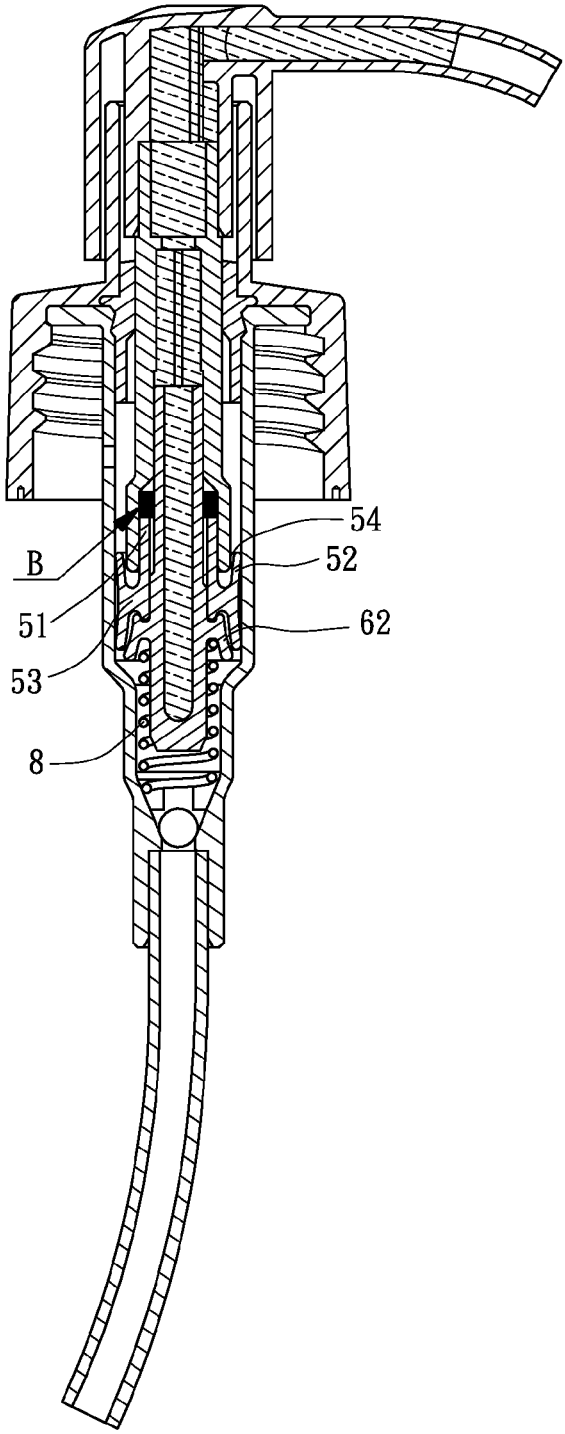
FIG. 4 is a cross-sectional view for showing the lower periphery which departs from a connecting ring when the user releases the press cover.
Figure 5:
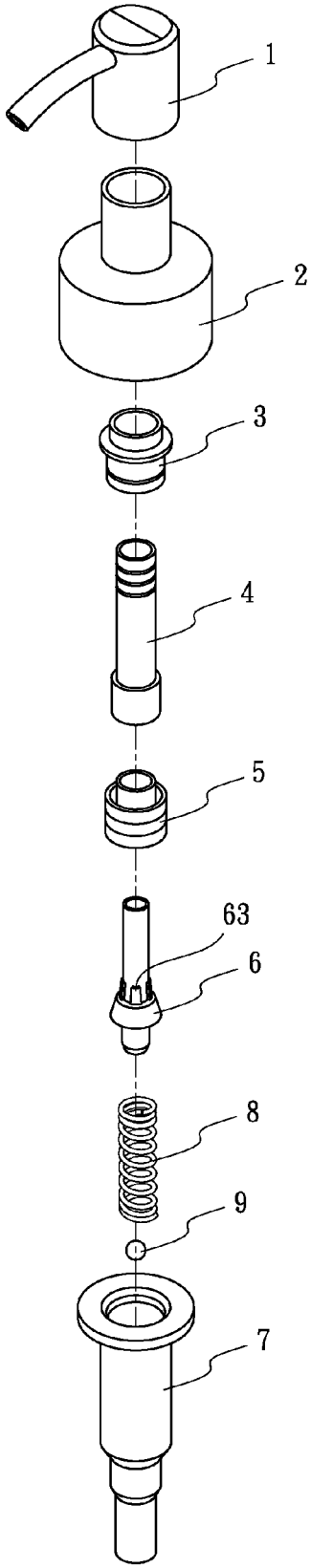
FIG. 5 is an exploded view of the non-dripping suck-back nozzle of the present invention.
Figure 6:
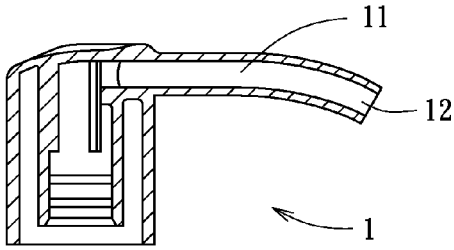
FIG. 6 is a cross-sectional view of the press cover.
Figure 7:
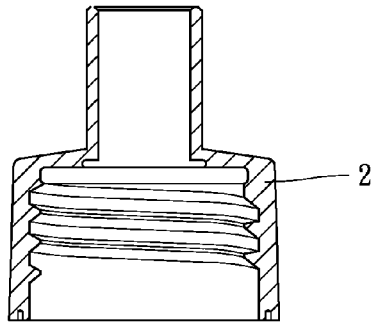
FIG. 7 is a cross-sectional view of a revolving cover.
Figure 8:
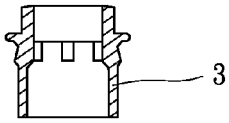
FIG. 8 is a cross-sectional view of a first piston.
Figure 10:
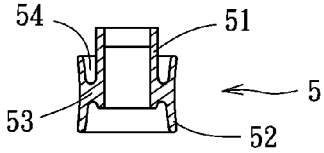
FIG. 10 is a cross-sectional view of a second piston.
Figure 9:
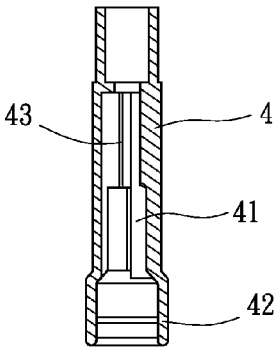
FIG. 9 is a cross-sectional view of a connecting bar.
Figure 11:
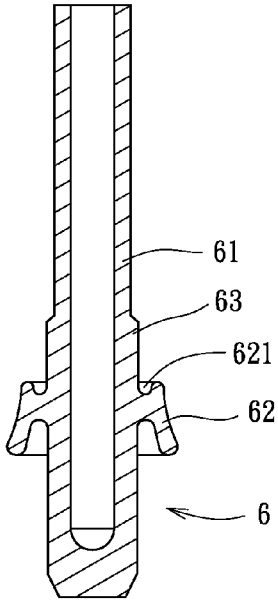
FIG. 11 is a cross-sectional view of a needle valve.
Figure 12:
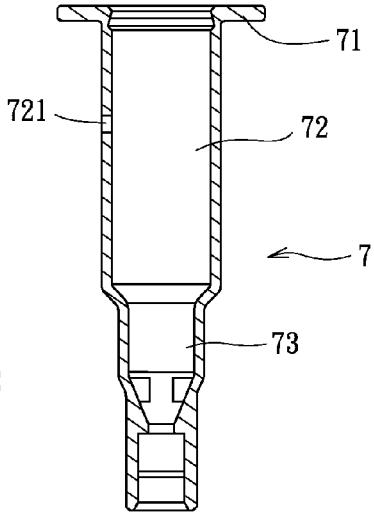
FIG. 12 is a cross-sectional view of a cylinder.

Referring to FIG. 4, when the user releases the press cover 1, the elasticity of the spring 8 moves the needle valve 6 toward the second piston 5 until the top end of the outer part 52 abuts against the bottom end of the first piston 3; then, the annular groove 621 of the needle valve 6 abuts against the inner round pole 51 of the second piston 5 so that it is airtight between the second piston 5 and the needle valve 6 and the fluid cannot flow into the second sub channel; finally, the lower periphery 42 of the connecting bar 4 departs from the connecting ring 53 of the second piston 5. In addition, because the lower periphery 42 departs from the connecting ring 53, a space between the connecting bar 4 and the needle valve 6 is enlarged (the space between the connecting bar 4 and the needle valve 6 is labeled as "A" in FIG. 3 before being enlarged; the space between the connecting bar 4 and the needle valve 6 is labeled as "B" in FIG. 4 after being enlarged.) so that the air pressure in the space between the connecting bar 4 and the needle valve 6 is reduced to make the fluid in the horizontal channel 11 near the outlet 12 flow toward the space between the connecting bar 4 and the needle valve 6 from the outlet 12. In addition, when the top end of the outer part 52 abuts against the bottom end of the first piston 3, the outer part 52 of the second piston 5 blocks the exhaust hole 721 so that the outside air cannot flow into the upper chamber 72.

All in all, when the user releases the press cover 1, the fluid in the horizontal channel 11 near the outlet 12 flows toward the space between the connecting bar 4 and the needle valve 6 from the outlet 12 rather than drop down from the outlet 12 as mentioned in the prior art.

Although the invention has been explained in relation to its preferred embodiment, it is to be understood that many other possible modifications and variations can be made without departing from the spirit and scope of the invention as hereinafter claimed.

What is claimed is:

1. A non-dripping suck-back nozzle which is set onto a dispenser comprising:

a press cover having a horizontal channel defined therein;

a revolving cover, the press cover being movable relative to the revolving cover, the revolving cover screwed onto the dispenser;

a cylinder being set into a top opening of the dispenser, the cylinder having a top shoulder formed around one end thereof, a bottom of the top shoulder abutting against the top opening of the dispenser, an upper chamber and a lower chamber both defined in the cylinder, at least one exhaust hole opened on the upper chamber of the cylinder;

a bead, a spring, a needle valve, a second piston and a connecting bar being set into the cylinder, the connecting bar axially connected to the press cover, the connecting bar having a hollow channel, the hollow channel communicating with the horizontal channel of the press cover;

the second piston having an inner round pole, an outer part and a connecting ring, the inner round pole being hollow, the outer part enclosing the inner round pole, the connecting ring formed between the inner round pole and the outer part, the connecting ring corresponding to a middle of the outer part, the inner round pole and the outer part and a top of the connecting ring defining a connecting ring-shaped groove, the connecting bar having a lower periphery defined at a lower end thereof, wherein when the lower periphery of the connecting bar is plugged into the connecting ring-shaped groove to abut against the connecting ring of the second piston, it is airtight between the second piston and the connecting bar;

the connecting bar and the second piston both set in the upper chamber of the cylinder, the bead being set in the lower chamber of the cylinder;

the needle valve having a round rod and a convex ring, the convex ring defined around the round rod, a top end of the round rod of the needle valve passing through the inner round pole of the second piston and the round rod inserted into the hollow channel of the connecting bar, the needle valve moved by the motion of the connecting bar which is axially moved by the press cover, a plurality of first sub channels defined between the connecting bar and the round rod so that a volume of fluid from the dispenser can flow into the horizontal channel of the press cover via the first sub channels, a plurality of second ribs which is extended upwardly from the convex ring being axially defined on the round rod, a plurality of second sub channels respectively defined by each two adjacent second ribs on the round rod and the inner round pole so that the fluid from the dispenser can flow into the first sub channel via the second sub channel; and an annular groove defined on the convex ring, one end of the spring abutting against a bottom of the lower chamber, another end of the spring enclosing the round rod and abutting against the convex ring of the needle valve; wherein the needle valve is moved toward the second piston by an elasticity of the spring until the annular groove of the needle valve abuts against the inner round pole of the second piston so that it is airtight between the second piston and the needle valve;

wherein, when the lower periphery of the connecting bar is plugged into the connecting ring-shaped groove to abut against the connecting ring of the second piston, the annular groove of the needle valve departs from the inner round pole of the second piston; when the annular groove of the needle valve abuts against the inner round pole of the second piston so that it is airtight between the second piston and the needle valve, the lower periphery of the connecting bar departs from the connecting ring of the second piston; in addition, because the lower periphery departs from the connecting ring, a space between the connecting bar and the needle valve is enlarged.

2. The non-dripping suck-back nozzle as claimed in claim 1, wherein a plurality of first ribs is axially defined on a wall of the hollow channel; the first ribs tightly abut against the round rod of the needle valve; the first sub channels are defined between the connecting bar and the round rod so that the fluid from the dispenser can flow into the horizontal channel of the press cover via the first sub channels.

3. The non-dripping suck-back nozzle as claimed in claim 1, wherein a top end and a bottom end of the outer part are both oblique from the inner round pole.

4. The non-dripping suck-back nozzle as claimed in claim 1, wherein a first piston is set into the cylinder; the first piston is fixed between the revolving cover and the top shoulder of the cylinder; the top end of the outer part of the second piston abuts against a bottom end of the first piston for limiting the second piston to over move upwardly.

* * * * *